United States Patent [19]

Deroulou et al.

[11] Patent Number: 5,058,457

[45] Date of Patent: Oct. 22, 1991

[54] ANVIL

[75] Inventors: Jean Deroulou, Roux; Claude Van Dorpe, Bousval; Philippe Van Scheepdael, Tournay, all of Belgium

[73] Assignee: Forges de Courcelles-Centre S.A., Courcelles, Belgium

[21] Appl. No.: 533,492

[22] Filed: Jun. 5, 1990

[30] Foreign Application Priority Data

Jun. 14, 1989 [BE] Belgium ..... 8900640

[51] Int. Cl.[5] ..... B21J 19/04

[52] U.S. Cl. ..... 76/101.1; 72/377

[58] Field of Search ..... 76/101.1; 72/377, 436, 72/437

[56] References Cited

U.S. PATENT DOCUMENTS 896,155 8/1908 Ring ..... 72/377

FOREIGN PATENT DOCUMENTS 448080 8/1927 Fed. Rep. of Germany .
524520 5/1931 Fed. Rep. of Germany .
415656 7/1910 France .
273634 7/1927 United Kingdom ..... 76/101.1

*Primary Examiner*—Roscoe V. Parker
*Attorney, Agent, or Firm*—Bell, Seltzer, Park & Gibson

[57] ABSTRACT

The disclosure relates to a steel anvil extending along a substantially horizontal axis and along a vertical axis and comprising a base (3), a body (2) possessing a round horn (8) and a square horn (15) arranged on either side of a face (10). The disclosure further relates to portable anvils intended in particular for the smithy, in order to enable a farrier to practice his art with a maximum of facilities, even under itinerant conditions.

16 Claims, 2 Drawing Sheets

ANVIL

BACKGROUND OF THE INVENTION

The invention relates to portable anvils intended in particular for the smithy, and more specifically to a model known as "double-beak" possessing, on either side of a face, two horns, one round and the other square, this portable double-beak anvil enabling a farrier to practice his art with a maximum of facilities even under itinerant conditions.

The market for smithy work has undergone very substantial changes within a relatively few years :

- the stock of horses has been greatly changed, since less and less use is made of draft horses. A substantial market still exists, particularly for saddle horses, hacks and horses intended for sport (racing, polo);
- moveover, the farrier's trade has also changed, since a wide variety of horseshoes of all sizes and styles are now commercially available in a finished state.

The farrier thus no longer has to forge the shoe, but simply to select the appropriate shoe and fit this shoe to the horse's foot.

This task still requires a very thorough knowledge of equine anatomy, but enables the farrier to manage with less extensive equipment.

Over the same time, a novel phenomenon has arisen, namely the fact that the horse is no longer brought to the smithy, but, on the contrary, the farrier himself travels to undertake the shoeing on site.

The farrier, however, despite the wide variety of shoes of which he can make use, is ultimately confronted by a special case with each horse which he is required to shoe. The shoe, however well fitting it may originally be, virtually always has to undergo a number of adjustments before being fitted.

Depending on their extent and on the nature of the shoe, these adjustments will be performed by hot or cold hammering.

The need has thus grown up for equipment for working the shoe which is both multi-purpose and portable, enabling this work to be carried out "in the field".

For example, small gas-fired hearths already exist, enabling the shoes to be heated under good conditions.

DESCRIPTION OF THE PRIOR ART

However, a problem arises in the case of the anvil, a tool which is indispensable to the farrier.

A traditional anvil of cast metal is completely non-portable and weighs up to 200 or 300 kg.

Means of expediency (metal blocks of whatever shape) are hardly to be recommended for the quality of work expected of a good craftsman.

Anvils used by goldsmiths neither withstand the energy applied nor enable the desired curvatures to be obtained.

"Light" anvils exist on the market (of the order of 30 kg), but they enable only a number of limited shapes to be obtained by hammering or twisting. The craftsman finds himself reduced to working with the shoes on a restricted surface and with a poor variety of radii of curvature, which not only causes him to waste much time but also prevents him from guaranteeing perfect work.

If he wishes to make use of an elongate double-beak anvil (which enables the shoes to be hammered into a wide variety of curvatures) and to have access to equipment offering wider possibilities, the craftsman is obliged to resort to a heavier anvil which then causes him problems of maneuverability.

Document DE-C-448,080 describes an anvil formed from an ingot whereof one end is shaped as a base, the other end being crushed, perpendicularly to the initial axis of the ingot, the fibers of the metal being aligned roughly in the direction of the axis of the face. The strength of the metal, although increased, is not sufficient to enable a light anvil having a large working surface to be obtained.

Application GB-A-273,634 describes a method of manufacturing an anvil by oxygen cutting from a metal ingot, it being possible for various pieces to be added subsequently by welding. However, application GB-A-273,634 gives no indication of a manner of thus producing a particularly strong anvil, of reduced weight and having a large working surface.

BRIEF SUMMARY OF THE INVENTION

The object of the invention is to produce an anvil, essentially for smithy use, which is easily portable by a single man, has extended working surfaces and nevertheless possesses excellent robustness.

Another object is that this anvil should offer a wide variety of support points for the shaping of metal objects.

A more specific object of this anvil is to be able to work horseshoes of all sizes thereon.

Another object is that this anvil should possess a long service life.

Another object is to market a high-quality tool for the working of shoes at a reasonable manufacturing cost.

The invention relates to a steel anvil extending along a substantially horizontal longitudinal axis and along a vertical axis and comprising a base, a body possessing a round horn and a square horn arranged on either side of a face, in the direction of the longitudinal axis, and a post connecting the body to the base in the direction of the vertical axis; in this anvil the base is in the form of a plate and has a substantially planar undersurface whose length, in the direction of longitudinal axis, is greater than its width in a direction perpendicular to that axis; the post widens towards the top and towards the bottom from an intermediate zone of narrower section; the anvil as a whole is formed by a first part comprising the body and a post section defined by a plane substantially parallel to the undersurface of the base and situated in said zone of narrower section, and a second part comprising the base and a post section defined by this same plane; these two parts, mutually connected by a weld having high compressive strength and fatigue strength, have been shaped by forging, in a manner such that the steel which forms them possesses a fibrous structure wherein the fibers are preferably oriented in the direction of the longitudinal axis in the body and in the base, and in the direction of the vertical axis in each of the two post sections.

According to a preferred embodiment, this anvil weighs between 20 and 30 kg.

According to an advantageous embodiment, the anvil body is of steel alloyed with nickel, chrome and molybdenum, possessing a high degree of resilience at both high and low temperatures and being suitable for forging.

Likewise, according to an advantageous embodiment of the anvil, the base is of carbon steel suitable for forging.

The free ends of the two post sections preferably possess a chamfer over their circumference, these chamfers forming, when the post sections are assembled, a groove capable of accommodating a weld seam, the free end of at least one of the two sections being offset in its central part, and a rib existing along this circumference. The rib has, advantageously, a width of between 1 and 5 mm.

In accordance with a preferred embodiment, the chamfer of the post section connected to the body forms an angle of between 20 and 40 with the plane defining the two post sections.

According to another preferred embodiment, the chamfer of the post section connected to the base forms an angle of 10 to 30° with the plane defining the two post sections.

The round horn of the anvil preferably has a width greater than 22 cm.

The anvil advantageously possesses a planar surface under the upper surface of the face, parallel thereto, substantially at the level of the upper ridge of the round horn.

Preferably, a square aperture is made in the upper surface of the face, said aperture being of dimensions suitable for the insertion of anvil tools and being pierced from side to side in a manner such that an extracting member for said tools may be introduced through the lower orifice of this square aperture.

According to a preferred embodiment, a working surface is provided between the edge of the square aperture and the edge of the face.

According to an advantageous embodiment, an oval aperture, having rounded edges in one plane, suitable for the shaping of aluminum horseshoes, passes through the face from side to side.

According to another advantageous embodiment, two rounded lugs of different curvatures, separated by a distance substantially corresponding to the width of a horseshoe project from the side of the face.

Another subject of the invention is a method of manufacturing a steel anvil extending along a substantially horizontal longitudinal axis and along a vertical axis and comprising a base, a body disposed in the direction of the longitudinal axis and a post connecting the body to the base in the direction of the vertical axis, wherein said method comprises the following operations :

- preforming by drop forging of a piece of alloy steel intended to form the blank for an anvil body (2) and for an attached post section;
- preforming by drop forging of a second piece of steel intended to form the blank for a base (3) and for an attached post section;
- forging by drop forging of the blank intended to form the body of the anvil and an attached post section;
- forging by drop forging of the second blank intended to form the base for the anvil and an attached post section, the body and the base being stamped in a manner such that the steel whereof they are formed adopts a fibrous structure, the fibers of this structure being preferentially orientated in the direction of the longitudinal axis of the future anvil in the body and in the base, and in the direction of the vertical axis in the post sections;
- soft annealing of the body and of the base at a temperature in the range between 600 and 700° C.;
- machining of a contact surface at the free end of the post sections respectively attached to the body and to the base;
- forming of a chamfer over the circumference of each of the contact surfaces;
- end-to-end welding of these free ends along the perimeter of the contact surface;
- annealing of the anvil at a temperature in the range between 600 and 700° C.;
- heating of the anvil at a temperature in the range between 800 and 900° C.;
- oil quenching of the anvil;
- tempering of the anvil at a temperature in the range between 600 and 700° C.,
- and machining and finishing of the anvil.

Advantageously, the method further comprises the offsetting of the end of one of the post sections in its central part, a rib being formed along the circumference of this end.

It is apparent that the preferential orientation of the fibers passes progressively from an orientation in the direction of the longitudinal axis (in the body and in the base) to an orientation in the direction of the vertical axis (in the two post sections), this being a consequence of the deformations which the blanks have been caused to undergo during forging.

An advantage of the invention is that, as a result of its manner of manufacture, the structure of the steel is axially orientated, which makes it possible for its dimensions, and hence its weight, to be substantially reduced while its strength remains equal; the central mass of a traditional anvil is here reduced to a pillar of restricted dimension.

Another advantage is that the horns possess a substantial offsetting, which permits more precise working.

Another advantage is that, each anvil being produced in two pieces, it is possible to use steels of different grades for the base and the body, so that it is not necessary to use for the base a steel of such good quality as that used for the body.

Another advantage is that, in view of the extent of the working surface, highly differentiated operations can be performed with great precision (in particular, drawing of toe-clips).

BRIEF DESCRIPTION OF THE SEVERAL VIEWS

Other features and advantages of the invention will become apparent from the description of a particular embodiment which follows, reference being made to the attached drawings, wherein.

DETAILED DESCRIPTION OF THE DRAWINGS

Figure 1:
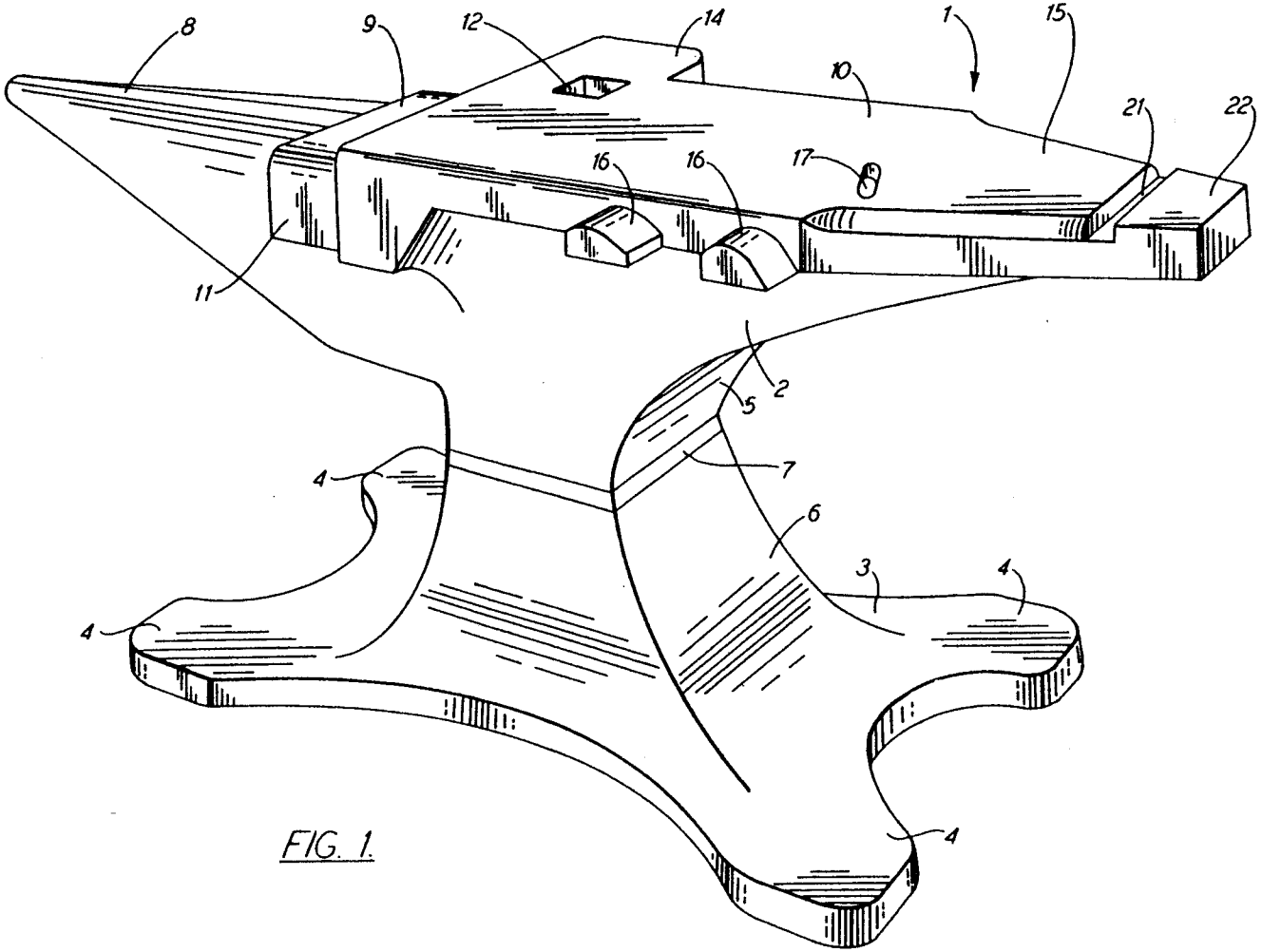
FIG. 1 is a perspective view of a portable anvil according to the invention.
Figures 2, 3, 4, 5:
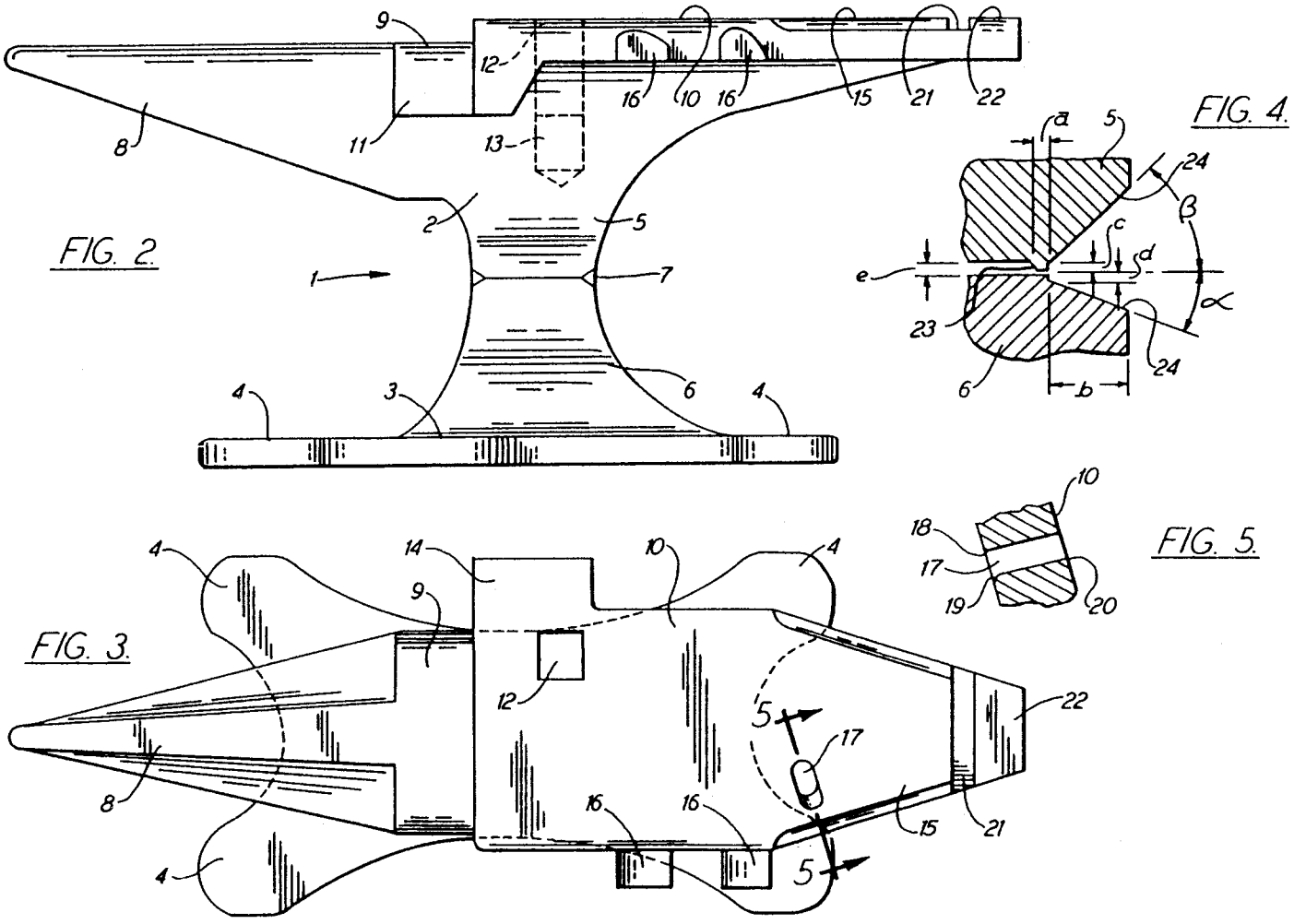
FIG. 2 is an elevated view of the same anvil.
FIG. 3 is a plan view of this anvil.
FIG. 4 is a partial view in section of the plane of junction between the body and the base.
FIG. 5 is a view in discontinuous section along the plane V—V in FIG. 3.

With reference more specifically to FIGS. 1 and 2, it will be found that the anvil 1 according to the invention comprises two distinct parts, the body 2 and the base 3. These two parts are disposed in the direction of the same horizontal axis.

The base 3 is of flattened shape and possesses four feet 4 which extend in the manner of the four corners of a quadrilateral whose long side is arranged in the direction of the axis of the anvil, the short side of this quadrilateral being wider than the projection of the body over the base 3. The body 2 and the base 3 are joined at their center by two post sections 5, 6 which taper away from each of these two parts 2, 3 and are joined by a weld 7 at their free ends.

At one side, the body 2 is prolonged in the direction of the longitudinal axis by a round horn 8, whose upper ridge is horizontal and whose length is, in this example, approximately 23 cm. This horn 8 has the advantage of a substantial offset over its entire length, so that it is possible to work shoes thereon by presenting them at virtually any angle without being unduly impeded by the body 2 or by the base 3.

A planar surface called a "level-break" forms the transition between the base of the round horn 8 and a face 10 which occupies the upper surface of the body 2.

This level-break 9 possesses two vertical flanks 11 and rounded corners, which enables shoes of larger sizes to be worked conveniently thereon, such as shoes for draft horses.

A face 10 having sharp corners extends in the upper part of the body 2, enabling conventional work to be carried out. A square aperture 12 of standardized dimensions is pierced from side to side of the face 10. This aperture 12 enables the tools (not shown) to be accommodated therein which are suitable for the working and fashioning of the shoe. The lower orifice 13 of the square aperture 12 simplifies the extraction of the tools after use (by inserting a lever, for example).

A shoulder 14 having sharp corners is formed on the side of the square aperture 12 and projects in a manner such that toe-clips of all sizes can easily be drawn.

The face 10 is extended at its other end, without solution of continuity, by the upper surface of the square horn 15 (also called the heel). The upper ridges of the square horn are rounded in a manner such as to facilitate the opening of shoes of different sizes. It also makes it possible for the shoes to be cold-worked.

The restricted cross-section of the post (5, 6) of the anvil means that the undersurface of the square horn 15 is also extensively offset, which facilitates working.

This particular shape, which is both light and strong, is made possible by the properties of the anvil, which derive from its method of manufacture. The fact that the anvil is designed in two parts makes it possible, in practice, to produce it by forging, thus obtaining a structure having oriented fibers and improved mechanical properties, and using a smaller quantity of raw material.

It will likewise be noted that the fact of working by drop forging makes it possible further to increase the forging ratio of the metal. Moreover, if laminated steel is used, it is possible to align the axis of the dies with the axis of the ingots, which enables the fiber of the metal to retain its original orientation and the forging ratio to be substantially increased without the provision of additional energy.

Two lugs of different shapes 16, set at a slight distance apart, project from the side of the face 10. Because of their well chosen spacing, it is possible to clamp the shoes therein in order to impart the desired shape to said shoes. These lugs 16 are particularly suitable for the working of aluminum-covered shoes, used in particular for racehorses.

The face 10 is likewise pierced from side to side by an oval slot 17 (shown in section in FIG. 5). The angles 18, 19, 20 of this slot 17 are rounded in the direction of the plane of its longer sides. Offset shoes (such as those used for racehorses) can be slid into this oval slot and worked easily.

A 10 mm slot 21 is made transversely close to the end 22 of the square horn 15, parallel to this end 22. Any type of shoe, even a shoe bearing toe-clips, can be easily punched out because of the presence of this slot 21.

It will be noted that despite the light weight of the anvil 1, a face 10 is obtained whose dimensions are convenient and enable any type of shoe to be "flattened out".

FIG. 4 shows in a more detailed manner the connection of the ends of the post sections 5, 6.

The two ends have been premachined so as to offer a contact plane substantially parallel to the base 3, the inner face of one of the ends being offset by a thickness e (where e is between 1 and 3 mm) so as to limit the contact between the two ends to a rib 23 of width a (where a is between 1 and 5 mm) which encircles the post, which allows the tension associated with differential shrinkage to be reduced.

A chamfer 24 is made over the periphery of each post section 5, 6, the wall of this chamfer 24 forming an angle $\alpha$ (for the base) and $\beta$ (for the body) with the plane defining the two post sections, $\alpha$ varying between 10 and 30° (with an optimum of 20°) and $\beta$ varying between 40 and 50° (with an optimum value of 45°), the base of the groove (c+d) being about 2 mm.

When the two ends of the post sections 5, 6 are attached, the two chamfers 24 form a suitable groove for inserting a weld seam between the body 2 and the base 3.

We claim:

1. A steel anvil extending along a substantially horizontal longitudinal axis and along a vertical axis and comprising a base (3), a body (2) possessing a round horn (8) and square horn (15) arranged on either side of a face (10), in the direction of the longitudinal axis, and a post (5, 6) connecting the body (2) to the base (3) in the direction of the vertical axis, the base (3) being in the form of a plate having a substantially planar undersurface whose length, in the direction of the longitudinal axis, is greater than its width in a direction perpendicular to that axis, wherein the post (5, 6) widens towards the top and towards the bottom from an intermediate zone of narrower section, the anvil (1) as a whole being formed by a first part comprising the body (2) and a post section (5) defined by a plane substantially parallel to the undersurface of the base (3) and situated in said zone of narrower section, and of a second part comprising the base (3) and a post section (6) defined by this same plane, these two parts, mutually connected by a weld (7) having high compressive strength and fatigue strength, each having been shaped by forging, in a manner such that the steel which forms them possesses a fibrous structure wherein the fibers are preferably oriented in the direction of the longitudinal axis in the body (2) and in the base (3), and in the direction of the vertical axis in each of the two post sections.

2. The anvil as claimed in claim 1, wherein the forging by which each of the parts of the anvil has been shaped is drop forging.

3. The anvil as in claim 2, wherein the post (5, 6) has, in its narrower section, a length less than one fifth of the distance separating the ends of the horns (8, 15), the dimensions being taken parallel to the longitudinal axis of the anvil.

4. The anvil as claimed in claim 3, wherein, in its narrower section, the length of the post (5, 6) is less than one seventh of the distance separating the ends of the horns (8, 15).

5. The anvil as claimed in claim 3, wherein the horns (8, 15) are fashioned in a manner such that they possess on the undersurface, from the end to the base, a substantial offsetting, in a manner such that the user can work rounded articles therein without being impeded by the body (2) or by the base (3).

6. The anvil as claimed in claim 3, wherein said anvil weighs between 20 and 30 kg.

7. The anvil as claimed in claim 3, wherein the body (2) is of steel alloyed with nickel, chrome and molybdenum, possessing a high degree of resilience at both high and low temperatures and being suitable for forging.

8. The anvil as claimed in claim 7, wherein the base (3) is of carbon steel suitable for forging.

9. The anvil as claimed in claim 3, wherein the free ends of the two post sections, (5, 6) possess a chamfer (24) over their circumference, these chamfers (24) forming, when the post sections are assembled, a groove capable of accommodating a weld seam (7), the free end of at least one of the two sections being offset in its central part, and a rib (23) existing along this circumference.

10. The anvil as claimed in claim 3, wherein the round horn (8) has a length greater than 22 cm.

11. The anvil as claimed in claim 3, wherein a square aperture (12) is made in the upper surface of the face (10), said aperture being of dimensions suitable for the insertion of anvil tools and being pierced from side to side in a manner such that an extracting member for said tools may be introduced through the lower orifice (13) of this square aperture (12).

12. The anvil as claimed in claim 11, wherein a working surface (14) is provided between the edge of the square aperture (12) and the edge of the face (10).

13. The anvil as claimed in claim 3, wherein an oval aperture (17) having rounded edges in one plane, suitable for the shaping of aluminum horseshoes, passes through the face (10) from side to side.

14. The anvil as claimed in claim 3, wherein two rounded lugs (16) of different curvatures, set apart by a distance substantially corresponding to the width of a horseshoe, project from the side of the face (10).

15. A method of manufacturing a steel anvil extending along a substantially horizontal longitudinal axis and along a vertical axis and comprising a base, a body disposed in the direction of the longitudinal axis and a post connecting the body to the base in the direction of the vertical axis, wherein said method comprises the following operations :

preforming by drop forging of a piece of alloy steel intended to form blank for a body (2) and for an attached post section (5);

preforming by drop forging of a second piece of steel intended to form the blank for a base (3) and for an attached post section (6);

forging by drop forging of the blank intended to form the body (2) of the anvil (1) and the attached post section (5);

forging by drop forging of the second blank intended to form the base (3) of the anvil (1) and the attached post section (6), the body (2) and the base (3) being stamped, in a manner such that the steel whereof they are formed adopts a fibrous structure, the fibers of this structure being preferentially orientated in the direction of the longitudinal axis of the future anvil, in the body (2) and in the base (3), and in the direction of the vertical axis in the post sections (5, 6);

soft annealing of the body (2) and of the base (3) at a temperature in the range between 600 and 700° C.;

machining of a contact surface on the end of the post sections respectively attached to the body and to the base;

forming of a chamfer (24) over the circumference of each of the contact surfaces;

end-to-end welding of these free ends of the body along the perimeter of the contact surface;

annealing of the anvil at a temperature in the range between 600 and 700° C.;

heating of the anvil at a temperature in the range between 800 and 900° C.;

oil quenching of the anvil;

tempering of the anvil at a temperature in the range between 600 and 700° C., and machining and finishing of the anvil.

16. The method as claimed in claim 15, wherein the method further comprises the following operation:

offsetting the end of one of the post sections (5, 6) in its central part, a rib being formed along the circumference of this end.

* * * * *